US007849925B2

(12) United States Patent
Patel

(10) Patent No.: US 7,849,925 B2
(45) Date of Patent: Dec. 14, 2010

(54) SYSTEM FOR COMPLETING WATER INJECTOR WELLS

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 160 days.

(21) Appl. No.: 12/211,855

(22) Filed: Sep. 17, 2008

(65) Prior Publication Data

US 2009/0078427 A1 Mar. 26, 2009

Related U.S. Application Data

(60) Provisional application No. 60/972,886, filed on Sep. 17, 2007.

(51) Int. Cl.
*E21B 34/06* (2006.01)
*E21B 43/00* (2006.01)

(52) U.S. Cl. ..... 166/334.4; 166/319; 166/334.1; 166/72

(58) Field of Classification Search ..... 166/334.4, 166/334.1, 321, 319, 72
See application file for complete search history.

(56) References Cited

U.S. PATENT DOCUMENTS

| | | | | |
|---|---|---|---|---|
| 4,775,009 | A * | 10/1988 | Wittrisch et al. | 166/250.11 |
| 4,991,654 | A * | 2/1991 | Brandell et al. | 166/332.7 |
| 5,375,661 | A | 12/1994 | Daneshy | |
| 6,374,913 | B1 * | 4/2002 | Robbins et al. | 166/66 |
| 6,899,176 | B2 * | 5/2005 | Hailey et al. | 166/278 |
| 7,021,388 | B2 | 4/2006 | Williams | |
| 7,210,532 | B2 | 5/2007 | Sherwood | |
| 7,428,929 | B2 | 9/2008 | Sherwood | |
| 7,445,048 | B2 | 11/2008 | Sheffield | |
| 7,469,748 | B2 | 12/2008 | Ocalan | |
| 7,591,312 | B2 * | 9/2009 | Johnson et al. | 166/278 |
| 2005/0155769 | A1 | 7/2005 | Sherwood | |
| 2006/0124310 | A1 * | 6/2006 | Lopez de Cardenas et al. | 166/313 |
| 2006/0207763 | A1 | 9/2006 | Hofman | |
| 2007/0215358 | A1 | 9/2007 | Messick | |
| 2008/0190622 | A1 | 8/2008 | Johnson | |
| 2009/0044944 | A1 * | 2/2009 | Murray et al. | 166/308.1 |

FOREIGN PATENT DOCUMENTS

| | | |
|---|---|---|
| GB | 2334276 | 8/1999 |
| GB | 2421746 | 5/2006 |
| GB | 2430962 | 4/2007 |
| WO | 2008091345 | 7/2008 |
| WO | 2009023611 | 2/2009 |

* cited by examiner

*Primary Examiner*—Giovanna C Wright

(57) ABSTRACT

A system for completing water injection wells includes an injector well completion system. In an embodiment, an injector well completion system for liquid injection in a formation includes a casing string disposed in a wellbore having a tubing bore. The casing string includes a casing and a sliding sleeve. The sliding sleeve has a pressure control valve having open and closed positions, an actuator mandrel having a flow control device, and an injection pressure communication port. The open position of the pressure control valve actuates the actuator mandrel to align the flow control device and the injection pressure communication port to inject liquid from the tubing bore to the formation and generate fractures in the formation.

21 Claims, 13 Drawing Sheets

SYSTEM FOR COMPLETING WATER INJECTOR WELLS

CROSS-REFERENCE TO RELATED APPLICATIONS

This application is a non-provisional of U.S. Application Ser. No. 60/972,886 filed on Sep. 17, 2007, which is incorporated by reference herein in its entirety.

BACKGROUND

Water injector wells involve injecting water into the formation. The water may be injected in the formation for purposes such as voidage replacement to maintain pressure, constrain gas cap, optimize well count, and maximize oil rate acceleration through producers. Various completion techniques have been developed in the industry for completion of water injector wells. For instance, conventional completion techniques include use of frac packs, open hole gravel packs, and stand alone screen completions. Drawbacks to conventional completion techniques include that large inner diameters may not be available, which may be required for completing wells with flow control valves used for proper water injection volume distribution in various zones. Drawbacks related to frac packs include their complexity and high expense. In addition, drawbacks related to open hole gravel packs include the typical high expense in achieving high differential pressure zonal isolation, which is often needed for intelligent completion. Drawbacks to stand along screen completions may include insufficient sand control completions.

Compliance and non-compliance expandable screens have been developed to overcome problems with conventional completion techniques. However, drawbacks to compliance and non-compliance expandable screens may include unreliability of the expandable screens over long periods. Further drawbacks include that the collapse rating of the compliance expandable screens may be low.

Consequently, there is a need for zonal isolation in water injector well completions. Further needs include a completion system for completing a water injector well that provides an inner diameter sufficient for the deployment of flow control valves and the like. Additional needs include a completion system that provides functionality of a cased hole for zonal isolation. In addition, needs include a more efficient system for water injector well completions that prevents cross flow between zones and prevents solids production.

BRIEF SUMMARY OF SOME OF THE PREFERRED EMBODIMENTS

These and other needs in the art are addressed in an embodiment by a completion system for liquid or gas injection in a formation. The completion system includes a casing string disposed in a wellbore. The casing string comprises a casing and at least one sliding sleeve. The at least one sliding sleeve is pressure actuated. The at least one sliding sleeve and casing are cemented in the wellbore.

These and other needs in the art are addressed in another embodiment by an injector well completion system for liquid injection in a formation. The injector well completion system includes a casing string disposed in a wellbore comprising a tubing bore. The casing string comprises a casing and a sliding sleeve. The sliding sleeve comprises a pressure control valve having open and closed positions, an actuator mandrel comprising a flow control device, and an injection pressure communication port. The open position of the pressure control valve actuates the actuator mandrel to align the flow control device and the injection pressure communication port to inject liquid from the tubing bore to the formation and generate fractures in the formation.

The foregoing has outlined rather broadly features and technical advantages of embodiments in order that the detailed description that follows may be better understood. Additional features and advantages will be described hereinafter that form the subject of the claims. It should be appreciated by those skilled in the art that the conception and the specific embodiments disclosed may be readily utilized as a basis for modifying or designing other embodiments for carrying out the same purposes. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments, reference will now be made to the accompanying drawings in which.

DETAILED DESCRIPTION OF THE PREFERRED EMBODIMENTS

Figure 1:
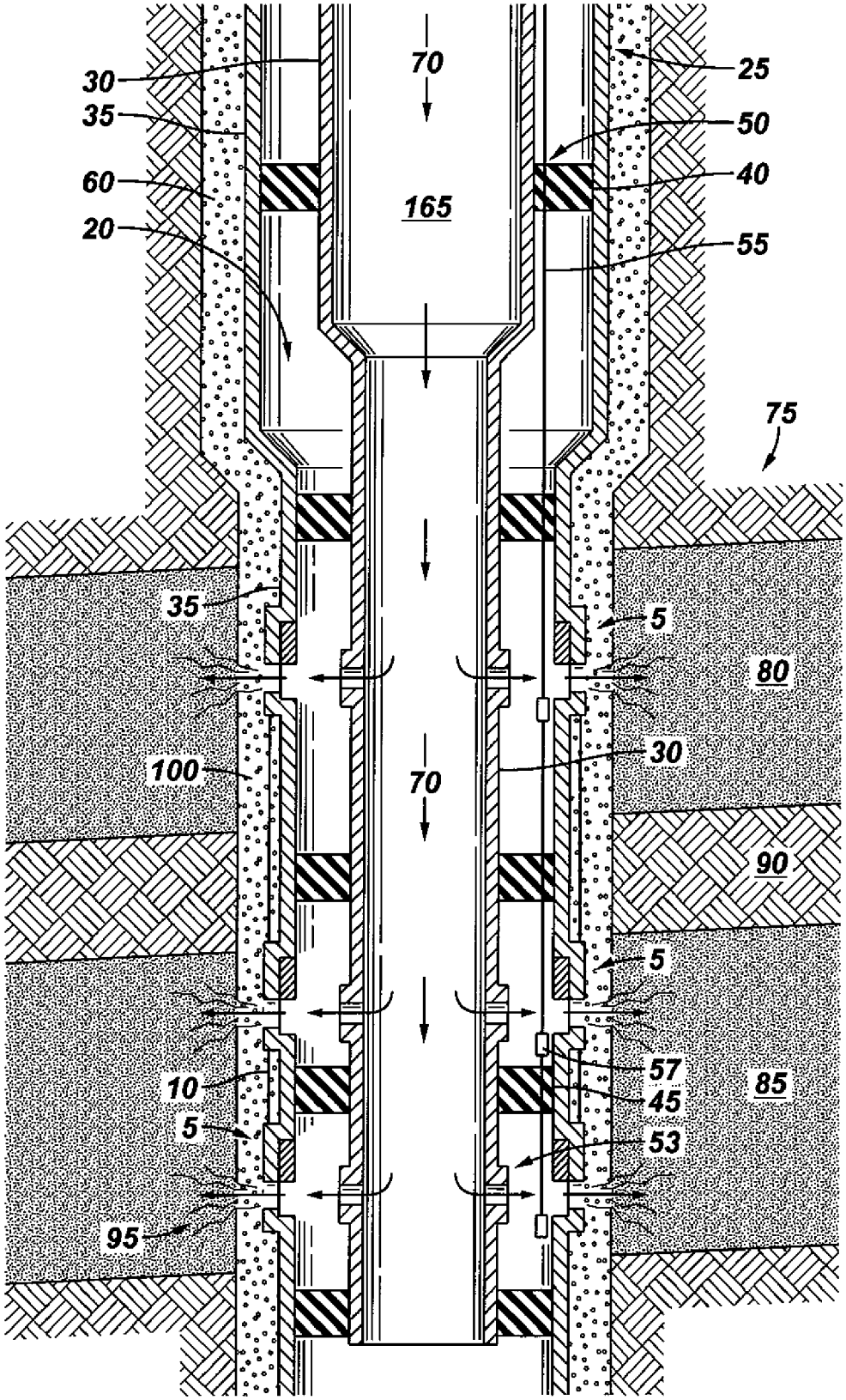
FIG. 1 illustrates a cross sectional side view of a wellbore with an injector well completion system having sliding sleeves and fixed choke inflow control devices.

FIG. 1 illustrates an embodiment of an injector well completion system 1 having sliding sleeves 5 disposed in wellbore 20. Tubing 30, casing string 25 with casing 35, production packer 40, and zonal isolation packers 45 are also disposed in wellbore 20. In the illustrated embodiment, injector well completion system 1 also includes fixed choke inflow control device 53, sensor bridle 55 and sliding sleeves 5 having backflow check valves 155 (illustrated in FIGS. 3-9). Packers 40, 45 may include any packers suitable for use in wellbore 20. In an embodiment as illustrated in FIG. 1, packers 40, 45 have feed through 50 through which sensor bridle 55 passes. Sensor bridle 55 includes attached sensors 57. Sensors 57 may include any sensors suitable for use in a wellbore 20 such as pressure sensors, temperature sensors, measurement fiber optics, continuous sensors, and discrete sensors. Sensors 57 may also include measurement systems that calculate flow allocation in each zone. In an embodiment, sliding sleeve 5 is run into wellbore 20 with casing 35 and cemented by a cement composition 60 in wellbore 20 with casing 35. Cement composition 60 may include any cement composition suitable for use in a wellbore. Tubing 30 and packers 40, 45 are run into wellbore 20 after cementing of casing string 25. Casing string 25 includes sliding sleeve 5. In the embodiment as illustrated in FIG. 1, casing string 25 includes more than one sliding sleeve 5. It is to be understood that casing string 25 is not limited to any number of sliding sleeves 5 but may include one sliding sleeve 5 or more than one sliding sleeve 5. Sliding sleeve control lines 10 connect the sliding sleeves 5 for pressure communication between the sliding sleeves 5. In the embodiment as illustrated in FIG. 1, injector well completion system 1 has a fixed choke inflow control device 53 for each sliding sleeve 5. In some embodiments, fixed choke inflow control device 53 is installed in sliding sleeve 5. Fixed choke inflow control device 53 may include any suitable inflow control device that with sliding sleeve 5 provides a desired flow distribution to formation 75. Injector well completion system 1 is not limited to inflow control device 53 being a fixed choke inflow control device but in some embodiments the inflow control device 53 may be a fixed choke, an orifice, or a passageway inflow control device.

As illustrated in FIG. 1, each sliding sleeve 5 may inject liquid 70 into formation 75. In an embodiment, liquid 70 may be any water suitable for water injector wells such as produced water. However, it is to be understood that liquid is not limited to water but may also include any other liquid suitable for use in a wellbore. In alternative embodiments, injector well completion system 1 includes a gas instead of a liquid 70 for injection. It is to be understood that flow of water is represented in FIG. 1 by arrows for illustration purposes. Formation 75 is shown in FIG. 1 with zones 80, 85 and impermeable rock 90. Impermeable rock 90 may be any rock that may be incapable of transmitting fluids and may isolate a zone (i.e., shale). It is to be understood that FIG. 1 shows zones 80, 85 for illustration purposes only but embodiments may include one zone or more than two zones. In the embodiment as illustrated in FIG. 1, sliding sleeves 5 are appropriately located in casing string 25 to inject liquid 70 into desired zones 80, 85 with the injection pressure breaking cement 100 and generating fractures 95 in formation 75. In embodiments, cement 100 between each sliding sleeve 5 provides zonal isolation between each sliding sleeve 5 and/or between zones. Zonal isolation refers to providing a seal, barrier, or restriction to prevent communication between zones. Each zone 80, 85 in formation 75 may have one or more sliding sleeves 5.

Figure 2:
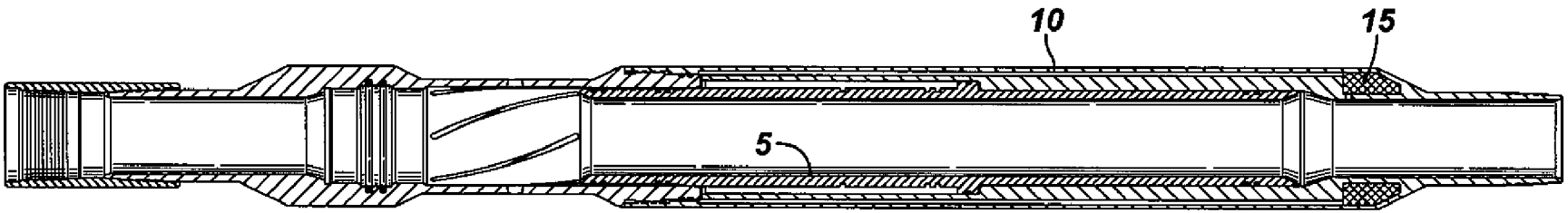
FIG. 2 illustrates a side view of a pressure communication passage and a sliding sleeve with a pressure control valve.

FIG. 2 illustrates a side view of an embodiment of sliding sleeve 5 having pressure control valve 15 and also showing sliding sleeve control line 10. Sliding sleeve 5 is openable and closeable by pressure communication. In an embodiment, the pressure is hydraulic pressure. The pressure communication is provided to sliding sleeve 5 by sliding sleeve control line 10. In an embodiment, pressure control valve 15 controls the pressure communication from tubing bore 165 (illustrated in FIG. 1) to sliding sleeve 5. Pressure control valve 15 may include any valves suitable for controlling the pressure communication to sliding sleeve 5 such as electronically activated triggers (i.e., E-triggers) and rupture discs. In an embodiment, pressure control valve 15 is a rupture disc. Any rupture disc suitable for use in wellbore conditions may be used. Without limitation, examples of suitable rupture discs include trigger rupture discs and staged pressure rated rupture discs.

Figure 3:
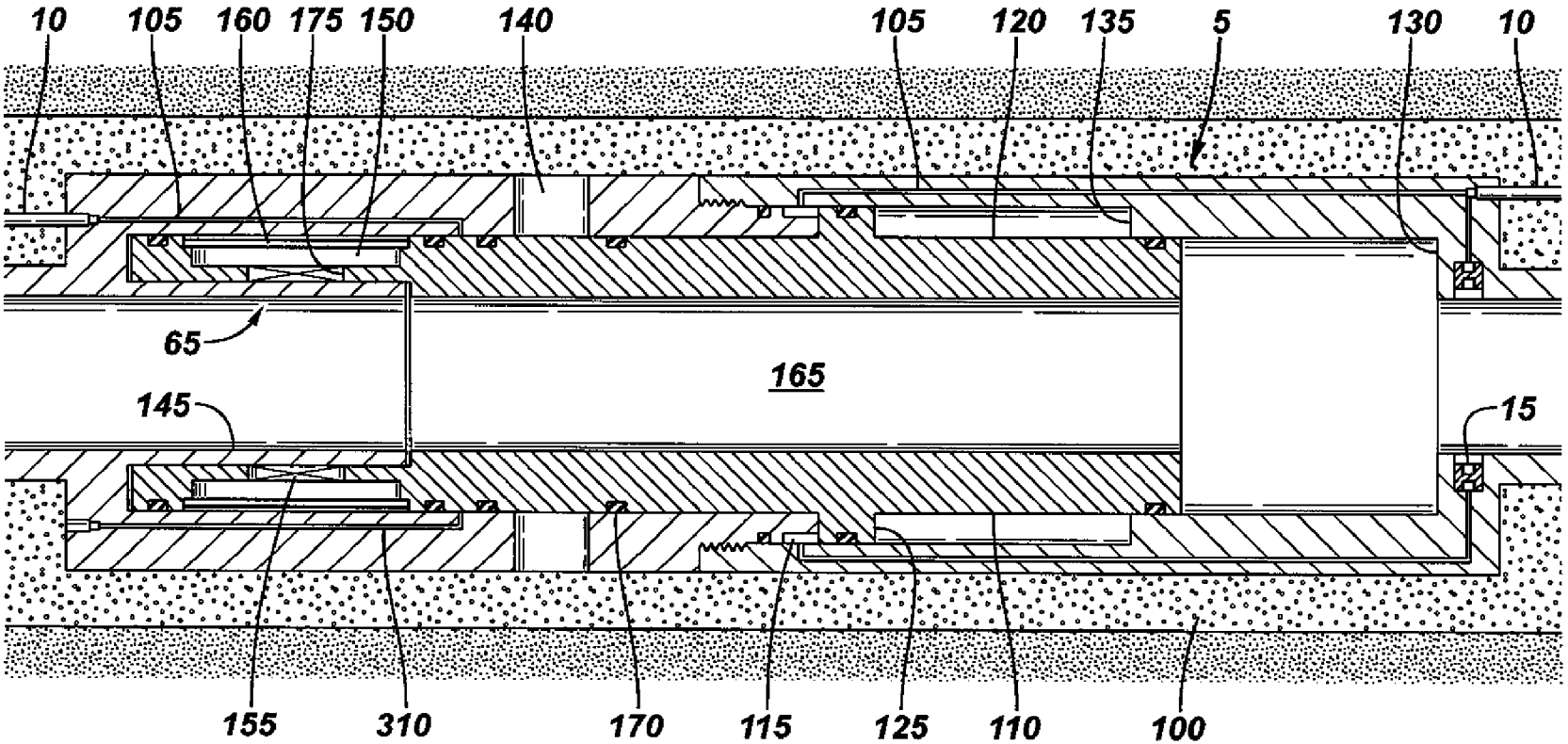
FIG. 3 illustrates a partial cross sectional side view of a sliding sleeve with a back flow check valve and with the sliding sleeve in a closed position.

FIG. 3 illustrates a partial cross sectional side view of an embodiment of sliding sleeve 5 having a back flow check valve 155. For illustration purposes only, tubing 30 is not illustrated in FIG. 3. FIG. 3 illustrates the embodiment of sliding sleeve 5 in a closed position with no liquid injecting pressure to cement 100. Sliding sleeve 5 has pressure communication passage 105, pressure control valve 15, actuator mandrel 110, injection pressure communication port 140, cover sleeve 145, a bottom sub 310 and top sub disposed opposite thereof. Pressure communication passage 105 may be a passageway, a hole, a line, or any other suitable method for pressure communication. Pressure communication passage 105 receives pressure from tubing bore 165. In alternative embodiments, pressure communication passage 105 provides and receives pressure from sliding sleeve control line 10. In the embodiment as illustrated in FIG. 3, pressure control valve 15 is a rupture disc. Sliding sleeve 5 includes atmospheric chamber 115 with an opening 315 formed between actuator mandrel 110 and the subs (see bottom sub 310). Actuator mandrel 110 includes piston 125 and flow control device 65. Piston 125 stops on shoulder 135 of bottom sub 310. Actuator mandrel 110 is longitudinally slidable. Flow control device 65 includes inflow chamber 150, back flow check valve 155, and screen 160. Cover sleeve 145 prevents solid particles from entering into inflow chamber 150 and back flow check valve 155 from tubing bore 165 when sliding sleeve 5 is in the closed position. Cover sleeve 145 is attached to the bottom sub 310. Back flow check valve 155 and screen 160 are disposed in inflow chamber 150. Back flow check valve 155 includes any valve suitable for preventing the flow of undesired solids from inflow chamber 150 to tubing bore 165. Back flow check valve 155 allows liquid 70 to be injected in formation 75 from tubing bore 165 but checks or stops the liquid 70 flow in the reverse direction from formation 75 or inflow chamber 150 into tubing bore 165. In some embodiments, back flow check valve 155 prevents the flow of liquid 70 from inflow chamber 150 to tubing bore 165. Without limitation, examples of back flow check valves 155 include sleeve back flow check valves, ball back flow check valves, concentric choke check valves, and the like. Back flow check valve 155 may be disposed at any location in inflow chamber 150 suitable for preventing fluids from flowing into tubing bore 165, which prevents solids production. In an embodiment as illustrated in FIG. 3, back flow check valve 155 is disposed in inflow chamber inlet 175. Screen 160 may be a screen of any mesh size suitable for preventing the flow of unwanted solids from injection pressure communication port 140 into tubing bore 165. In the embodiment as illustrated in FIG. 3, flow control device 65 is shown with back flow check valve 155 proximate to cover sleeve 145 and screen 160 distal to cover sleeve 145. In other embodiments (not illustrated), screen 160 is proximate to cover sleeve 145, and back flow check valve 155 is distal to cover sleeve 145. In alternative embodiments (not illustrated), flow control device 65 does not have screen 160. In another embodiment (not illustrated), flow control device 65 has screen 160 but not back flow check valve 155. In embodiments, sliding sleeve 5 also includes seals 170. Sliding sleeves 5 may be opened simultaneously, sequentially, or individually opened. For instance, in some embodiments, only one sliding sleeve 5 has a pressure control valve 15. When the pressure control valve 15 is opened, pressure is communicated to all the sliding sleeves 5 via sliding sleeve control line 10 for simultaneous opening of the sliding sleeves 5. In other embodiments, each sliding sleeve 5 has a pressure control valve 15, which allows sequential or individual opening depending on the pressure settings of each pressure control valve 15.

Figure 4:
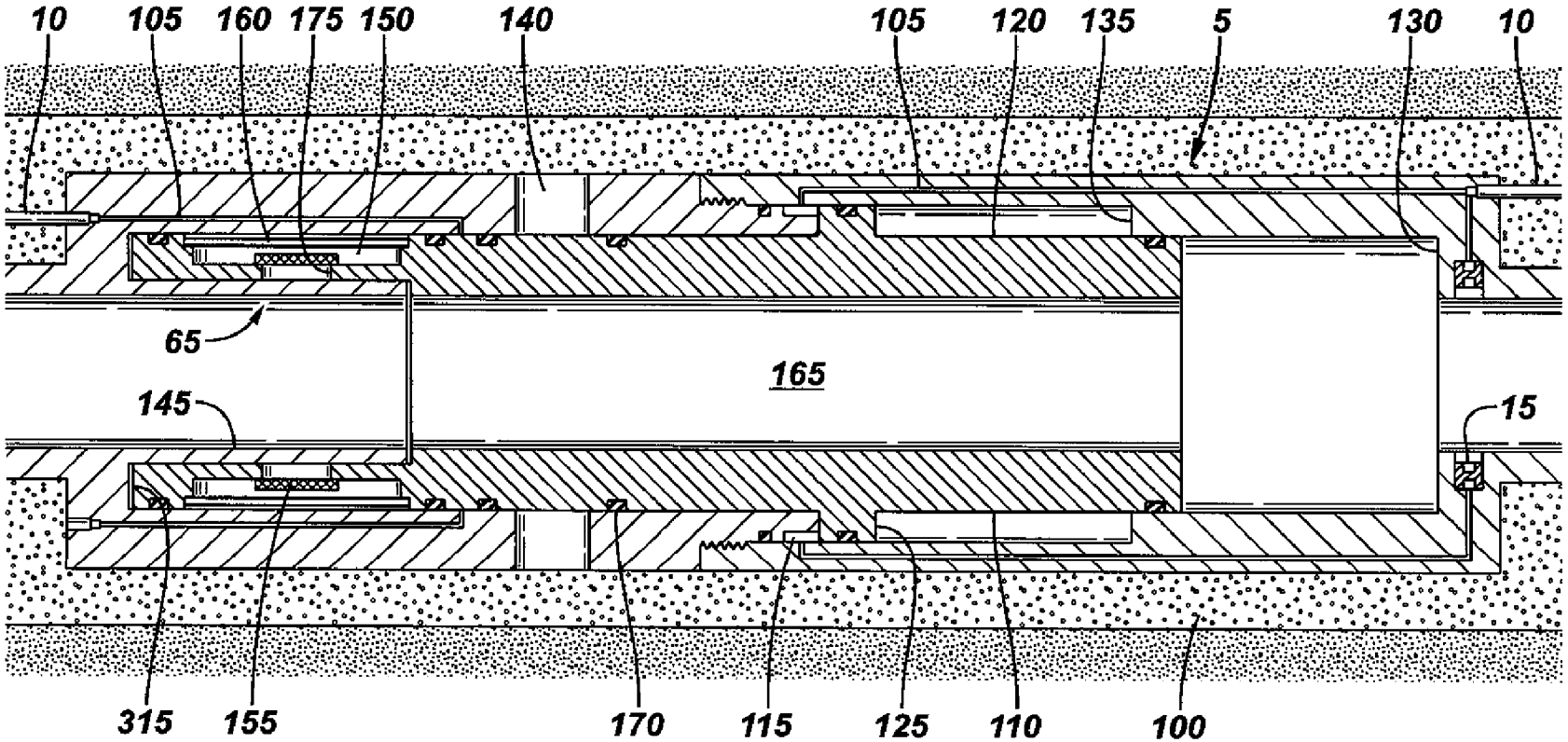
FIG. 4 illustrates a partial cross sectional side view of a sliding sleeve with a sleeve back flow check valve.

FIG. 4 illustrates a partial cross sectional side view of an embodiment of sliding sleeve 5 in which back flow check valve 155 is a sleeve back flow check valve. In FIG. 4, sliding sleeve 5 is shown in the closed position. Sleeve back flow check valve may be any material suitable for use in wellbore conditions and that is impermeable to liquid. Without limitation, the sleeve back flow check valve may be composed of rubber, metal, ceramic, and the like. In an embodiment, the sleeve back flow check valve is composed of rubber. The sleeve back flow check valve is not secured to actuator mandrel 110. When in the closed position, the sleeve back flow check valve prevents liquid flow between inflow chamber 150 and inflow chamber inlet 175.

Figure 5:
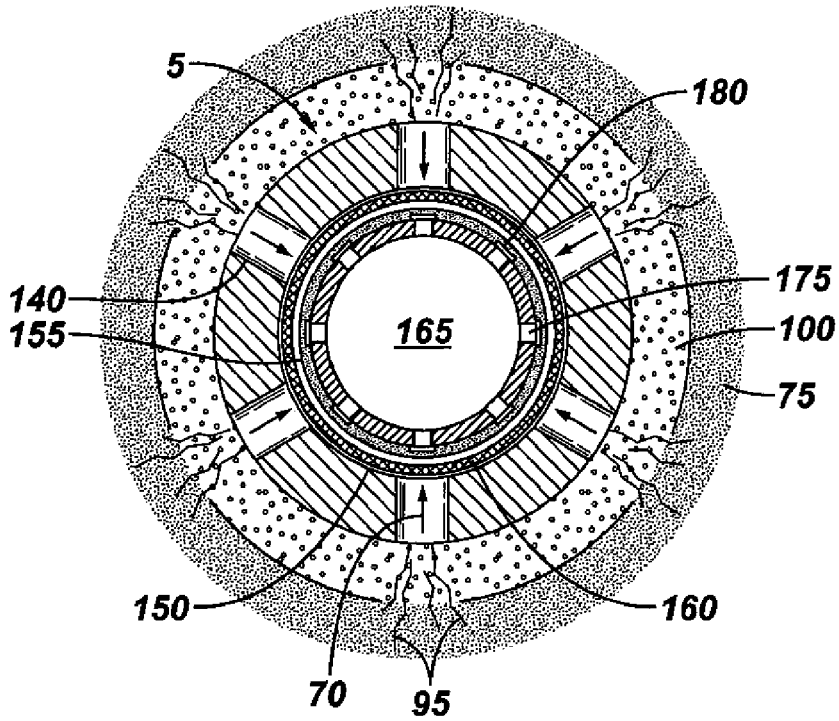
FIG. 5 illustrates a cross sectional view of the sleeve back flow check valve of FIG. 4.

FIG. 5 illustrates a cross sectional view of back flow check valve 155 of FIG. 4 in which back flow check valve 155 is a sleeve back flow check valve. FIG. 5 illustrates back flow check valve 155 during an injection shut down (i.e., sliding sleeve 5 is closed). As illustrated, the sleeve back flow check valve is in a radially contracted position. Without being limited by theory, pressure from liquid 70 flowing from injection pressure communication port 140 to inflow chamber 150 presses (i.e., radially contracts) back flow check valve 155 into a position against inflow chamber inlets 175 sufficient to prevent the flow of liquid 70 into tubing bore 165. Sliding sleeve 5 may have any suitable number and configuration of inflow chamber inlets 175 suitable for water injection. In an embodiment, inflow chamber inlets 175 have a spiral configuration about sliding sleeve 5. In some embodiments as illustrated in FIG. 5, back flow check valve 155 also includes back flow check valve guards 180. Back flow check valve guards 180 are sufficiently disposed on back flow check valve 155 to receive the liquid 70 impact. Without limitation, back flow check valve guards 180 reduce wear upon back flow check valve 155 by impact of liquid 70. Back flow check valve guards 180 may include any material suitable for use in wellbores such as metal, ceramic, and plastic. In an embodiment, back flow check valve guard 180 is metal.

Figure 6:
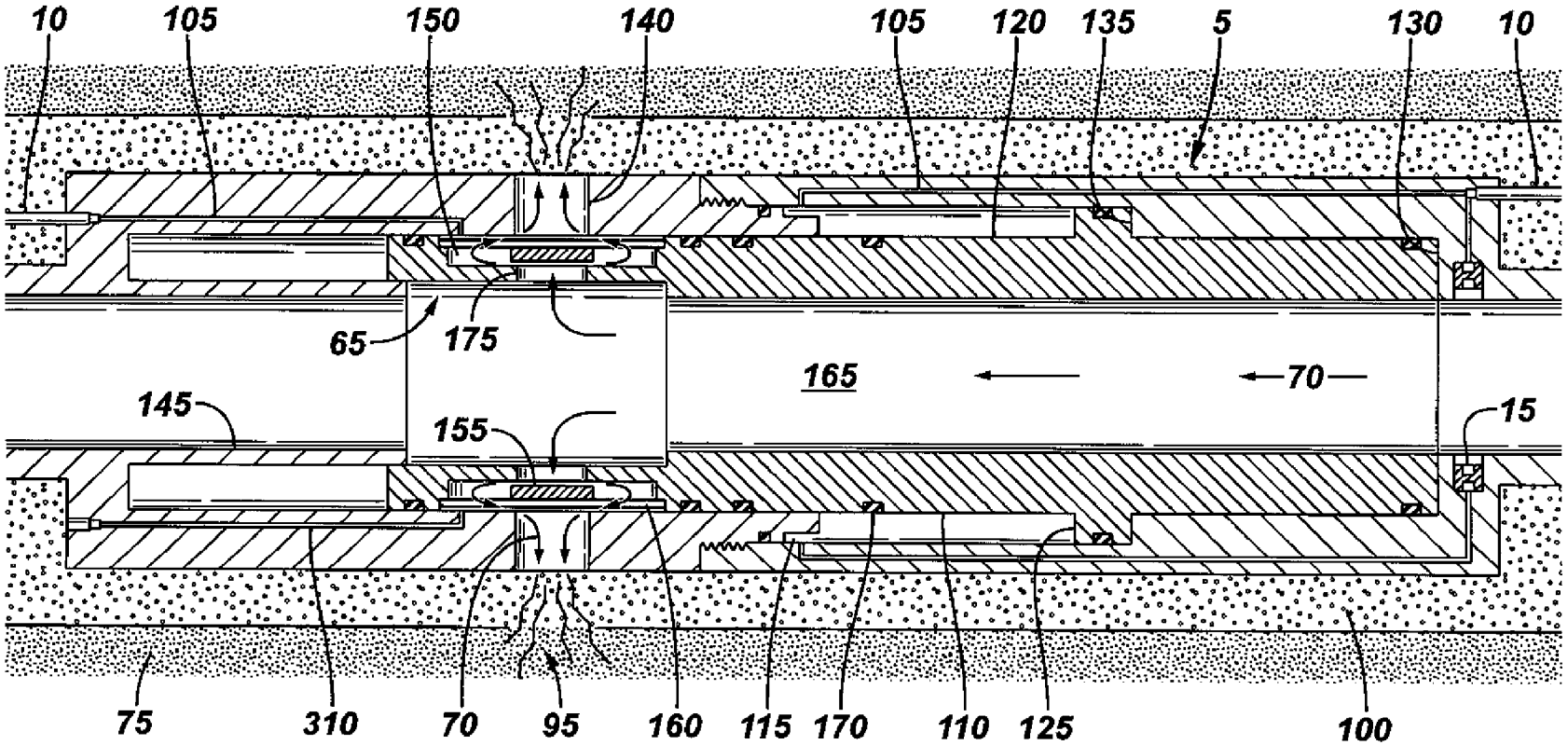
FIG. 6 illustrates the sliding sleeve of FIG. 4 in an open position.

FIG. 6 illustrates the embodiment of sliding sleeve 5 shown in FIG. 4 in an open position with injection of liquid 70 into formation 75 providing fractures 95. In such an embodiment, pressure communication from tubing bore 165 has opened pressure control valve 15. In this embodiment, pressure control valve 15 is a rupture disc, and the pressure communication has met or exceeded the set pressure of the rupture disc, thereby opening pressure control valve 15 and allowing liquid 70 to flow into pressure communication passage 105 and provide pressure to atmospheric chamber 115. The provided pressure in atmospheric chamber 115 actuates piston 125 with actuator mandrel 110 moving longitudinally (i.e., sliding) toward shoulder 135. In some embodiments, further longitudinal movement of actuator mandrel 110 is prevented when piston 125 contacts shoulder 135 and/or actuator mandrel 110 contacts mandrel stop 130. The longitudinal movement of actuator mandrel 110 moves flow control device 65 to align inflow chamber 150 with injection pressure communication port 140 and thereby commence the liquid 70 injection into cement 100 causing fractures 95 in cement 100 and formation 75. The flow of liquid 70 through tubing bore 165 to injection pressure communication port 140 is represented by the illustrated arrows. As shown in FIG. 6, with cover sleeve 145 no longer preventing flow from tubing bore 165 to inflow chamber inlet 175, liquid 70 flows through inflow chamber inlet 175 and radially expands back flow check valve 155 away from inflow chamber inlet 175, which allows liquid 70 to flow through inflow chamber 150 to injection pressure communication port 140 and to cement 100. In an embodiment in which flow control device 65 has screen 160, screen 160 prevents solids from passing through inflow chamber 150 to tubing bore 165. As further illustrated in FIG. 6, when in the open position, pressure communication passing through pressure communication passage 105 from inflow chamber 150 and pressure control valve 15 is communicated to sliding sleeve control lines 10 to other sliding sleeves 5 (not illustrated) in casing string 25.

Figure 7:
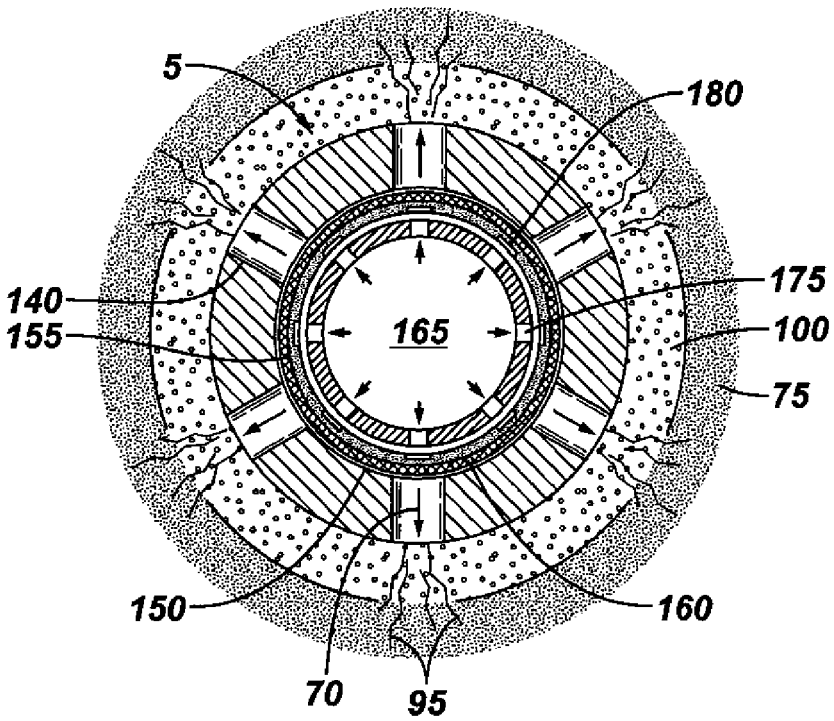
FIG. 7 illustrates a cross sectional view of the sleeve back flow check valve of FIG. 6.

FIG. 7 illustrates a cross sectional view of back flow check valve 155 of FIGS. 4-6 with sliding sleeve 5 in the open position. As illustrated, back flow check valve 155 (i.e., sleeve back flow check valve) is in a radially expanded position. Without limitation, pressure from liquid 70 flowing through inflow chamber inlet 175 radially expands back flow check valve 155 sufficient to allow the injection of liquid 70 through injection pressure communication port 140 to cement 100.

Figure 8:
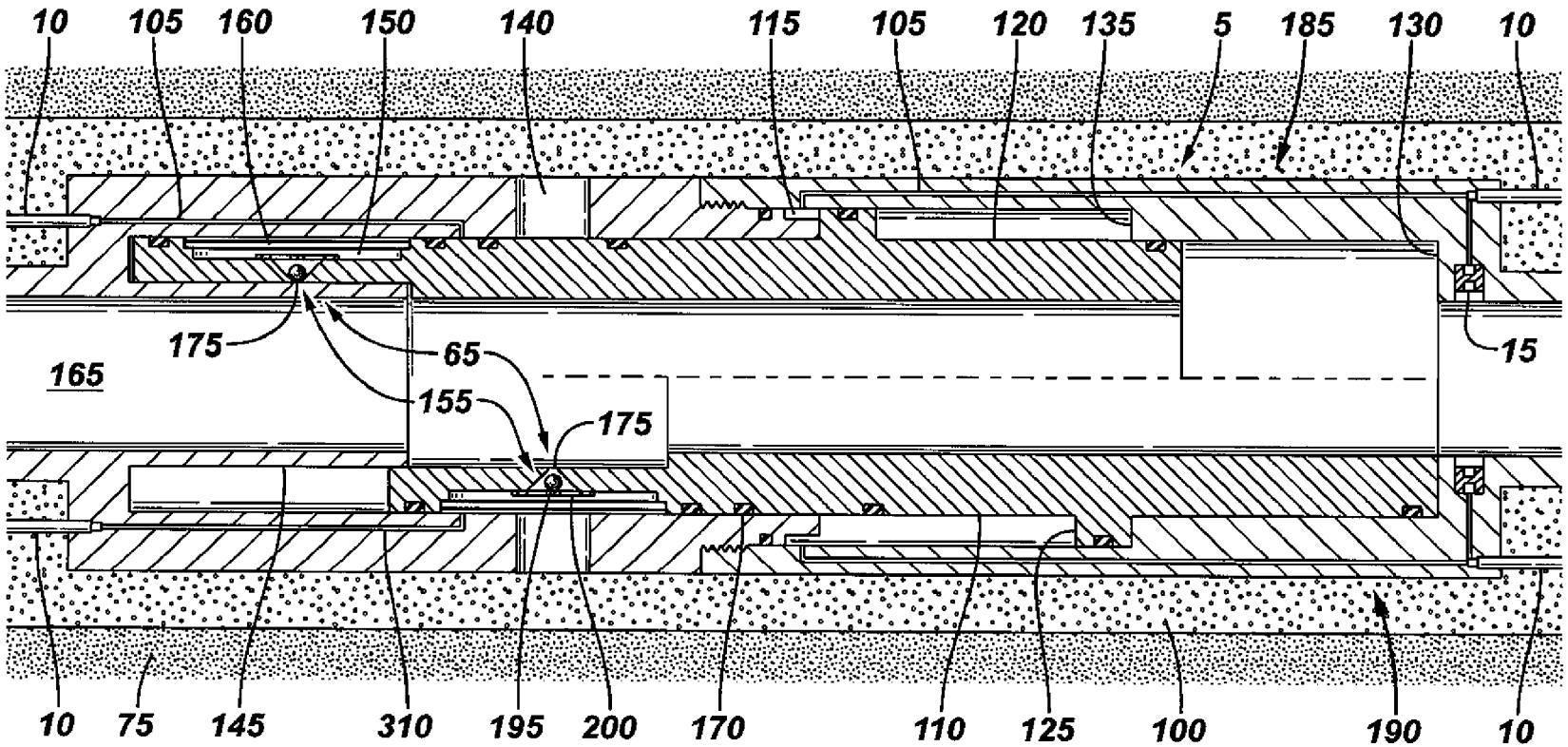
FIG. 8 illustrates a partial cross sectional side view of a sliding sleeve with a back flow check valve including a ball.

FIG. 8 illustrates a partial cross sectional side view of an embodiment of sliding sleeve 5 in which back flow check valve 155 is a ball back flow check valve. For illustration purposes only, top portion 185 of FIG. 8 is shown in the closed position, and bottom portion 190 is shown in the open position. In such an embodiment, back flow check valve 155 has ball 195 disposed in inflow chamber inlet 175. In such an embodiment, inflow chamber inlet 175 may have any suitable configuration by which ball 195 may not exit inflow chamber 150 to tubing bore 165 but that by which ball 195 closes off the liquid flow between inflow chamber 150 and tubing bore 165 during backflow. Backflow refers to the flow of liquid 70 (not illustrated) from injection pressure communication port 140 to inflow chamber 150. Without limitation, by closing off the liquid 70 flow between inflow chamber 150 and tubing bore 165 during backflow, ball 195 prevents liquid from formation 75 from entering tubing bore 165. In an embodiment as illustrated in FIG. 8, inflow chamber 150 has ball stop 200. Ball stop 200 may have any configuration suitable for preventing ball 195 from passing from inflow chamber inlet 175 to inflow chamber 150 and also that allows liquid 70 to flow from inflow chamber inlet 175 to inflow chamber 150. In alternative embodiments (not illustrated), inflow chamber 150 does not have ball stop 200.

Figure 9:
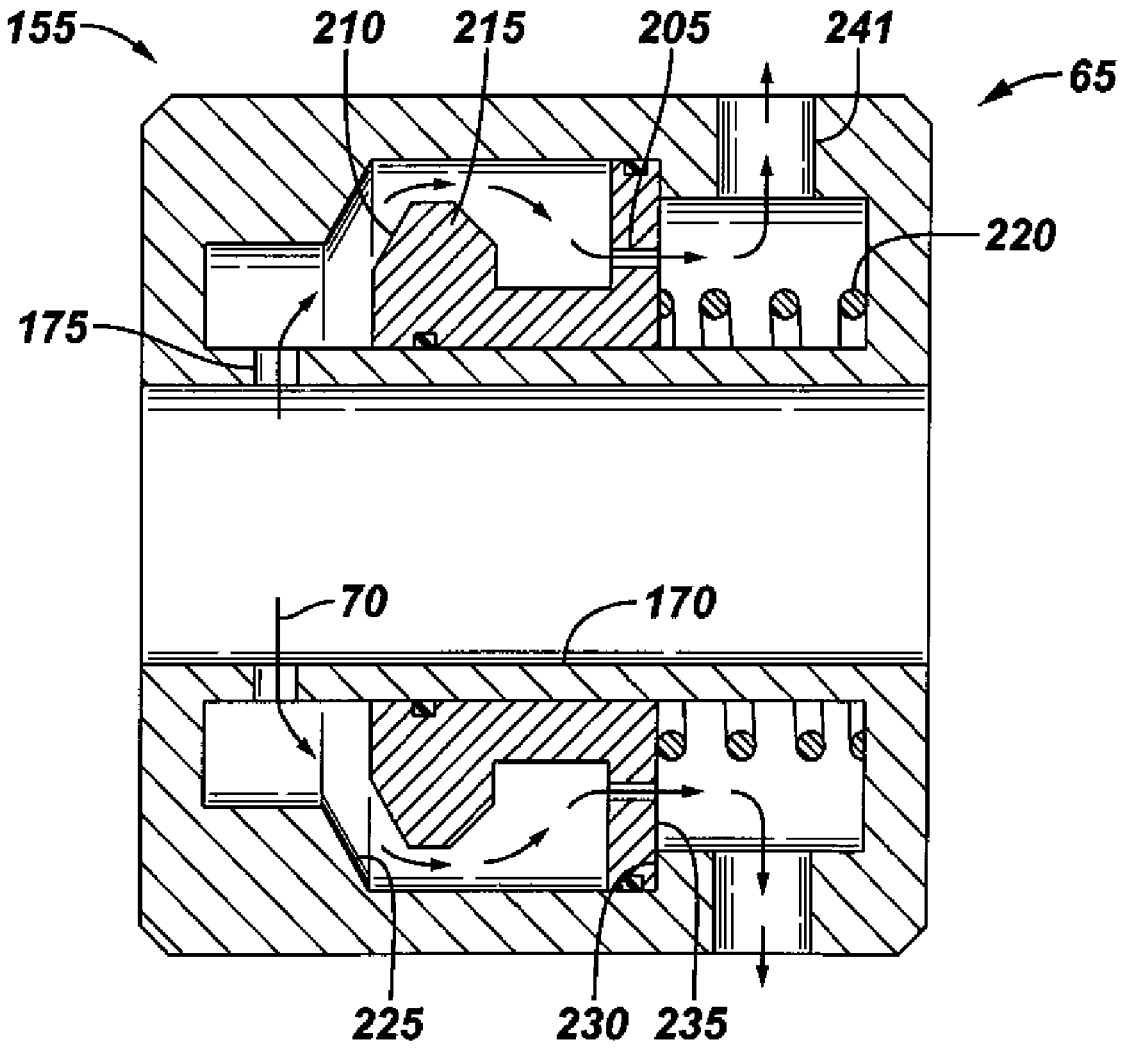
FIG. 9 illustrates a cross sectional side view of a back flow check valve including a concentric choke.

FIG. 9 illustrates a cross sectional side view of a flow control device 65 with back flow check valve 155 including a concentric choke 205. FIG. 9 is illustrated with sliding sleeve 5 (not illustrated) in a open position and liquid 70 flowing into inflow chamber inlet 175. In such an embodiment, back flow check valve 155 also includes seal face 210, choke piston 215, spring 220, choke piston stop 225, and choke stop 230. Choke piston 215 includes choke 205, which is an opening in choke piston 215 that allows liquid 70 to pass through choke piston 215. In some embodiments, the width of choke 205 is selected to allow a desired pressure of liquid 70 to be injected into formation 75 (not illustrated). Without limitation, choke 205 allows a uniform flow distribution into formation 75. Choke piston 215 is longitudinally slidable in inflow chamber 150. In the open position, pressure from liquid 70 acting upon choke piston 215 forces choke piston 215 to longitudinally move against spring 220 thereby compressing spring 220. Liquid 70 flows into inflow chamber 150 and through choke 205. Liquid 70 then exits inflow chamber 150 through inflow chamber outlet 241 to injection pressure communication port 140. In an embodiment, longitudinal movement of choke piston 215 is stopped when stop face 235 of choke piston 215 contacts choke stop 230, which is a portion of inflow chamber 150. In an embodiment in which back flow occurs and/or when sliding sleeve 5 is in a closed position, spring 220 expands and longitudinally pushes choke piston 215 in the direction of inflow chamber inlet 175. The longitudinal movement of choke piston 215 by spring 220 is stopped when choke piston 215 is at a position in which seal face 210 of choke piston 215 contacts choke piston stop 225, which is a portion of inflow chamber 150. At this position, choke piston 215 prevents back flow into tubing bore 165 from inflow chamber 150 and thereby prevents solids entering tubing bore 165 from formation 75.

As illustrated in FIGS. 1, 3-4, 6, and 8, one or more than one sliding sleeve 5 has a pressure control valve 15 (i.e., rupture disc). In an embodiment in which one sliding sleeve 5 has a pressure control valve 15, when the pressure control valve 15 opens (i.e., ruptures), pressure is communicated from pressure communication passage 105 of the sliding sleeve 5 with the pressure control valve 15 to the other sliding sleeves 5 that are connected via sliding sleeve control lines 10. In embodiments (not illustrated) in which a portion or all sliding sleeves 5 are not connected by sliding sleeve control lines 10, each of the sliding sleeves 5 not connected by sliding sleeve control lines 10 have a pressure control valve 15. In other alternative embodiments (not illustrated), casing string 25 only has one sliding sleeve control line 10. In such other alternative embodiments, the one sliding sleeve control line 10 has valves such as T-valves for each sliding sleeve 5 that communicates pressure to the sliding sleeves 5.

Figure 10:
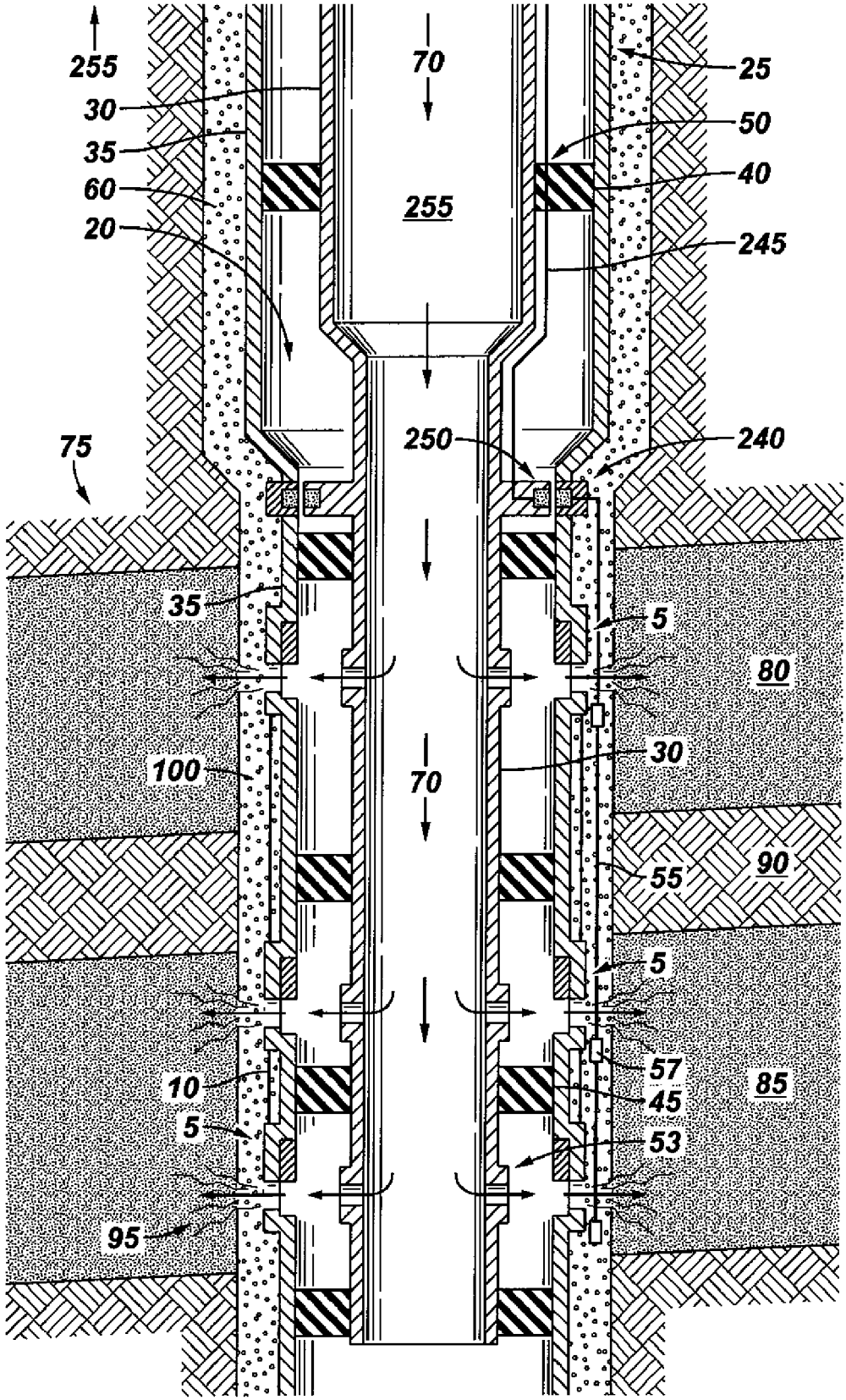
FIG. 10 illustrates a cross sectional side view of an injector well completion system with the sensor bridle disposed outside the casing.

FIG. 10 illustrates a cross sectional side view of injector well completion system 1 in which sensor bridle 55 is run outside of casing 35 and cemented in place with cement composition 60. Sensor bridle 55 is connected to inductive coupling 240. In an embodiment, a portion 250 of inductive coupling 240 is disposed between tubing 30 and casing 35. Electric cable 245 runs from surface 255 and is connected to portion 250 to communicate signals to and/or from sensors 57. In some embodiments, electric cable 245 provides power to sensors 57.

Figure 11:
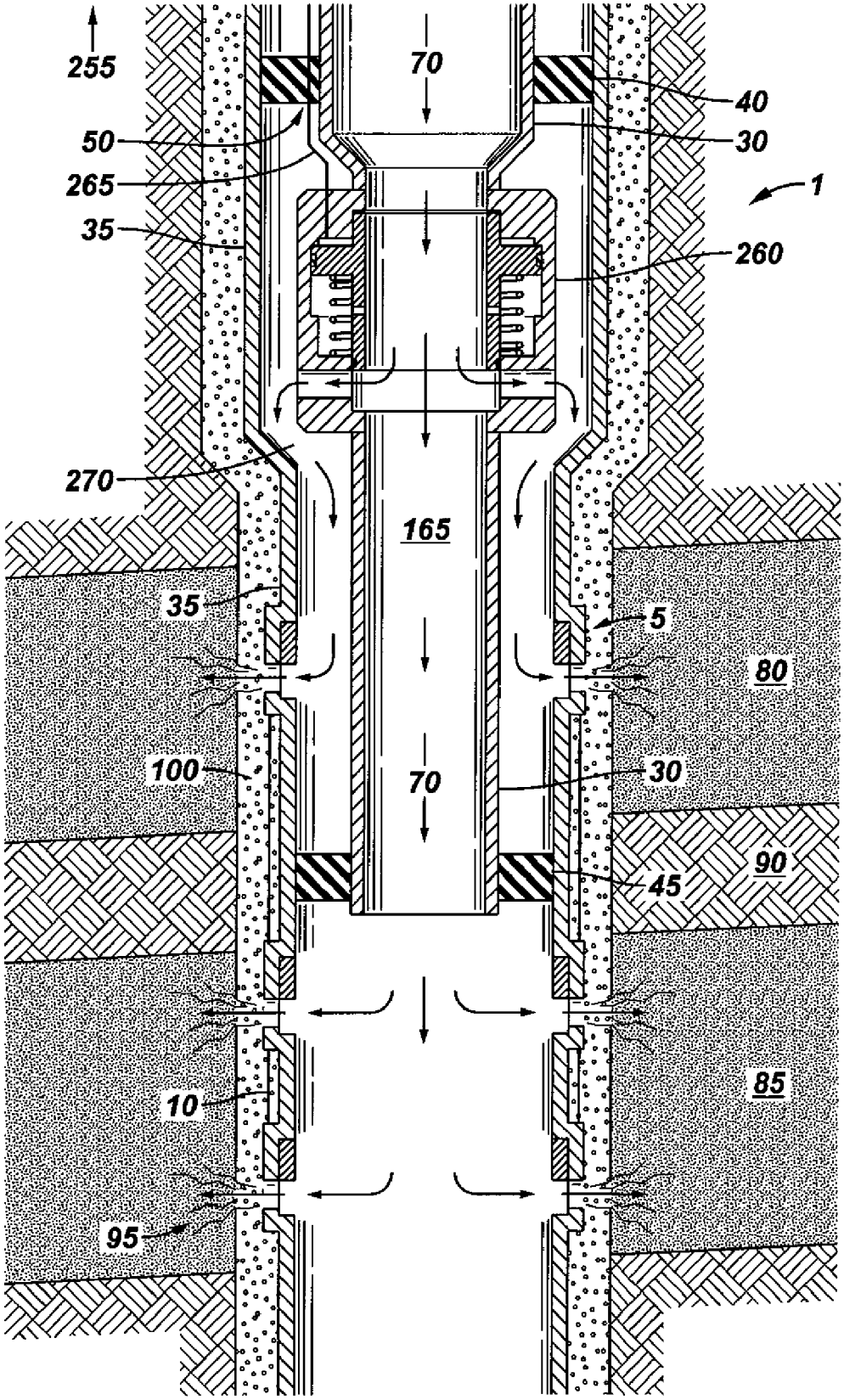
FIG. 11 illustrates a cross sectional side view of an injector well completion system having sliding sleeves and a flow control valve with a flow control line to the surface.

FIG. 11 illustrates a cross sectional side view of an embodiment of injector well completion system 1 including flow control valve 260. Without limitation, the embodiment of injector well completion system 1 shown in FIG. 11 isolates two zones. For instance, injector well completion system 1 isolates zones 80, 85. Flow control valve 260 may be any type of valve suitable for controlling flow in a wellbore. For instance, examples of suitable flow control valves 260 include sleeve flow control valves and ball flow control valves. In the embodiment illustrated in FIG. 11, flow control valve 260 prevents cross flow between zones 80, 85. Flow control valve 260 is actuated by control line 265, which runs to surface 255. In some embodiments, flow control valve 260 runs through production packer 40 via feed through 50. Control line 265 may be a hydraulic control line or an electric control line. Control line 265 communicates to flow control valve 260 whether to open and allow liquid 70 to flow from tubing bore 165 to isolated annulus zone portion 270 and therefore also as to whether zone 80 is injected with pressure from sliding sleeves 5. Isolated annulus zone portion 270 is isolated from tubing bore 165 by tubing 30, flow control valve 260, and zonal isolating packer 45. Isolated annulus zone portion 270 is shown with one sliding sleeve 5 but in some embodiments (not illustrated) has more than one sliding sleeve 5.

Figure 12:
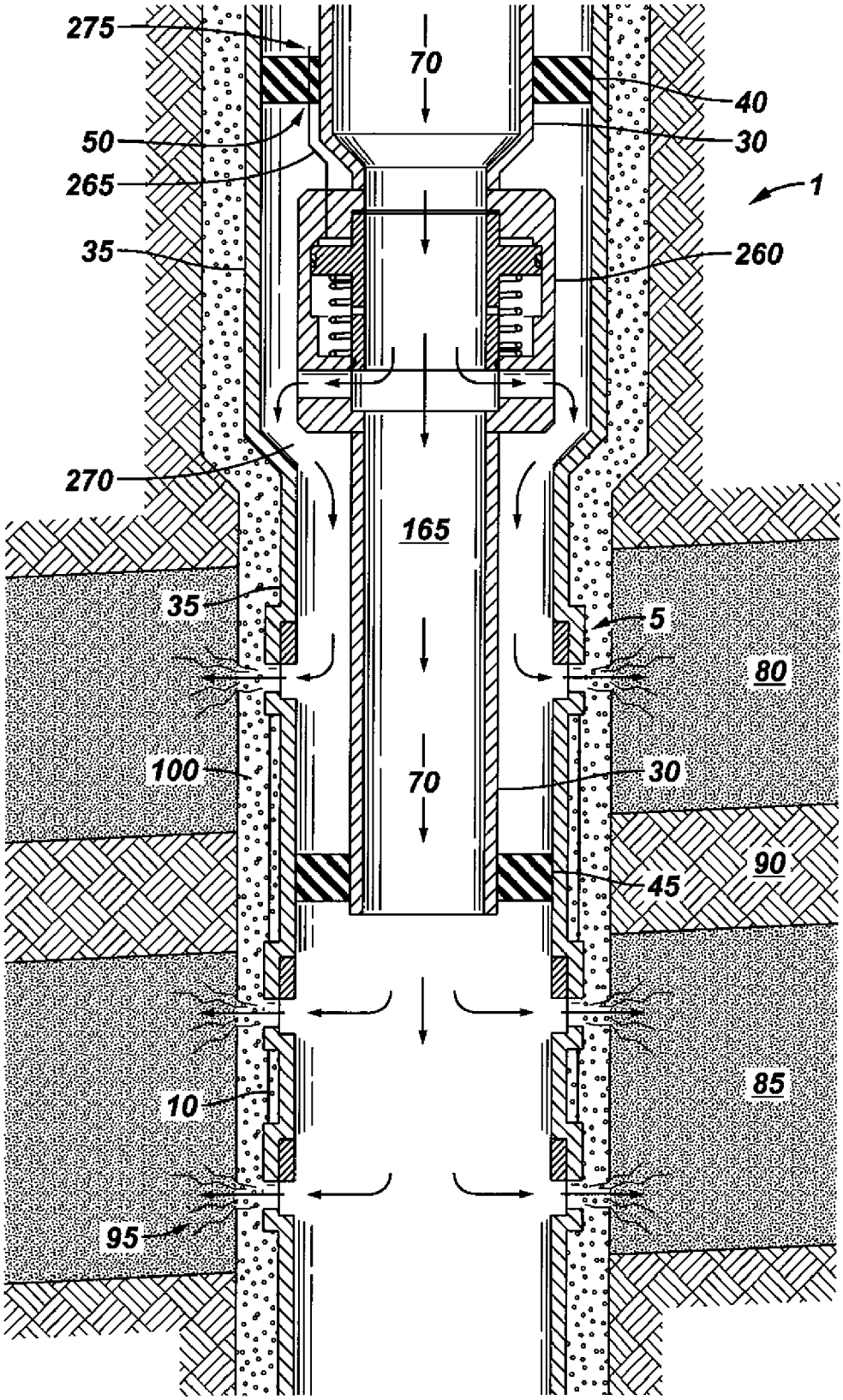
FIG. 12 illustrates a cross sectional side view of an injector well completion system having sliding sleeves and a flow control valve with an annulus pressure communication port.

FIG. 12 illustrates an embodiment of injector well completion system 1 with annulus pressure communication port 275 communicating to flow control valve 260 whether to open and allow liquid 70 to flow from tubing bore 165 to isolated annulus zone portion 270 and therefore also as to whether zone 80 is injected with pressure from sliding sleeves 5. Annulus pressure communication port 275 receives pressure communication from annulus 320 between tubing 30 and casing 35 above production packer 40 (see FIG. 1). Therefore, the pressure in annulus 320 is controlled to determine the pressure communication to annulus pressure communication port 275.

Figure 13:
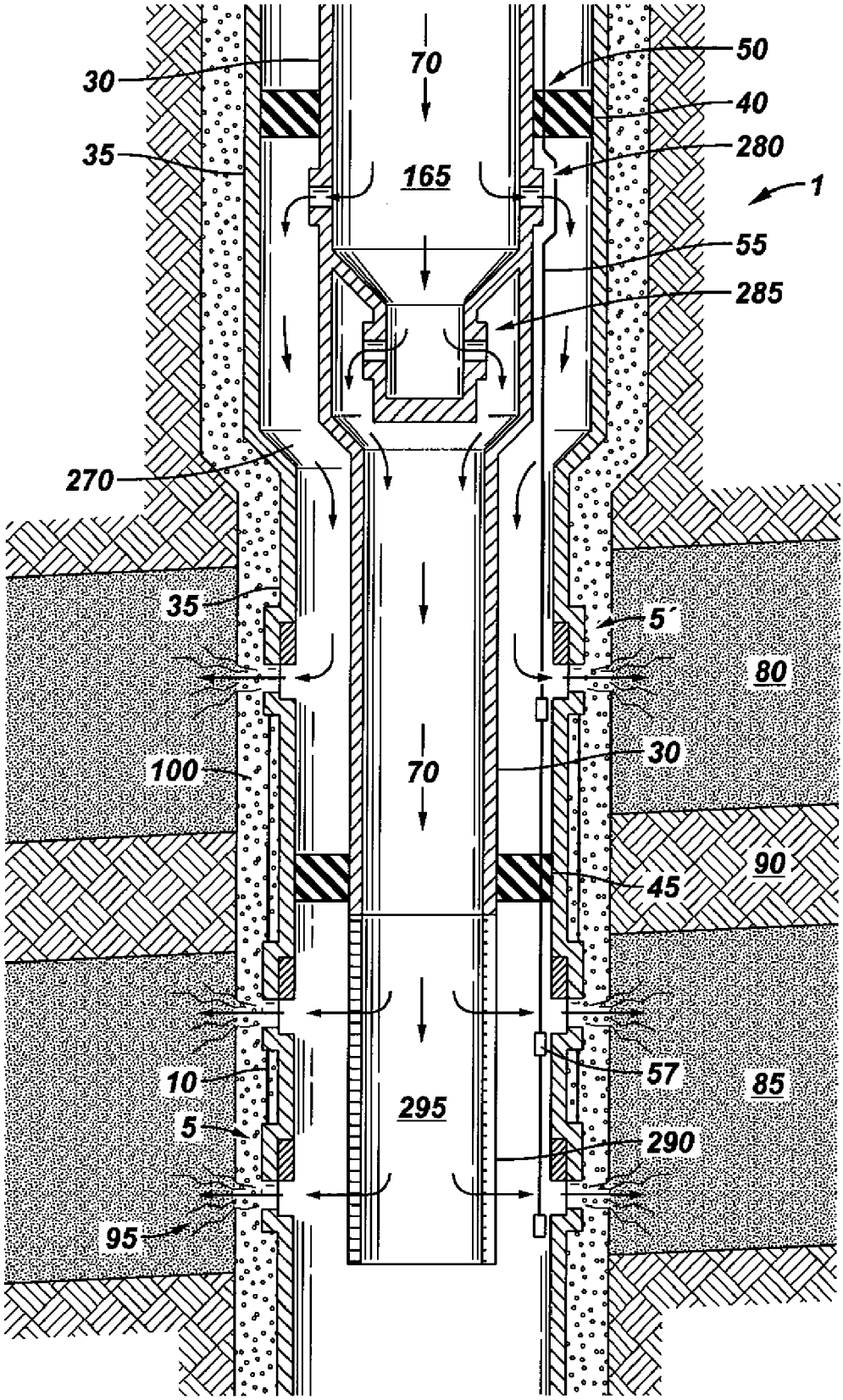
FIG. 13 illustrates a cross sectional side view of an injector well completion system having sliding sleeves and upper and lower flow control valves.

FIG. 13 illustrates a cross sectional side view of an embodiment of injector well completion system 1 including upper flow control valve 280 and lower flow control valve 285. Without limitation, the embodiment of injector well completion system 1 shown in FIG. 13 isolates two zones. For instance, injector well completion system 1 isolates zones 80, 85. Flow control valves 280, 285 may be any type of flow control valve suitable for controlling flow in a wellbore. For instance, examples of suitable flow control valves include sleeve flow control valves and ball flow control valves. In some embodiments, flow control valves 280, 285 receive actuation signals from flow control line 260 (not illustrated). Upper flow control valve 280 controls liquid 70 flow from tubing bore 165 to isolated annulus zone portion 270. In an embodiment in which a sliding sleeve 5' exposed to isolated annulus zone portion 270 has a pressure control valve 15, upper flow control valve 280 controls pressure communication to sliding sleeve 5'. In such an embodiment, when sliding sleeve 5' is actuated to an open position, pressure communication is communicated from sliding sleeve 5' via sliding sleeve control lines 10 to sliding sleeves 5 for injection to zone 85. In alternative embodiments (not illustrated) in which injector well completion system 1 has more than one sliding sleeve 5', the sliding sleeve 5' with pressure control valve 15 when actuated also communicates pressure communication to the other sliding sleeves 5'. Lower flow control valve 285 controls liquid 70 flow to isolated annulus portion 295, which is the portion of tubing bore 165 downhole from lower flow control valve 285 and isolated from isolated annulus zone portion 270. A portion of tubing 30 is perforated to provide perforated tubing 290. In an embodiment, the portion of tubing 30 downhole of zonal isolation packers 45 is perforated. Liquid 70 flow from lower flow control valve 285 flows through perforated tubing 290 to sliding sleeves 5, and, in embodiments in which sliding sleeves 5 are in open positions, is injected into zone 85 to produce fractures 95.

Figure 14:
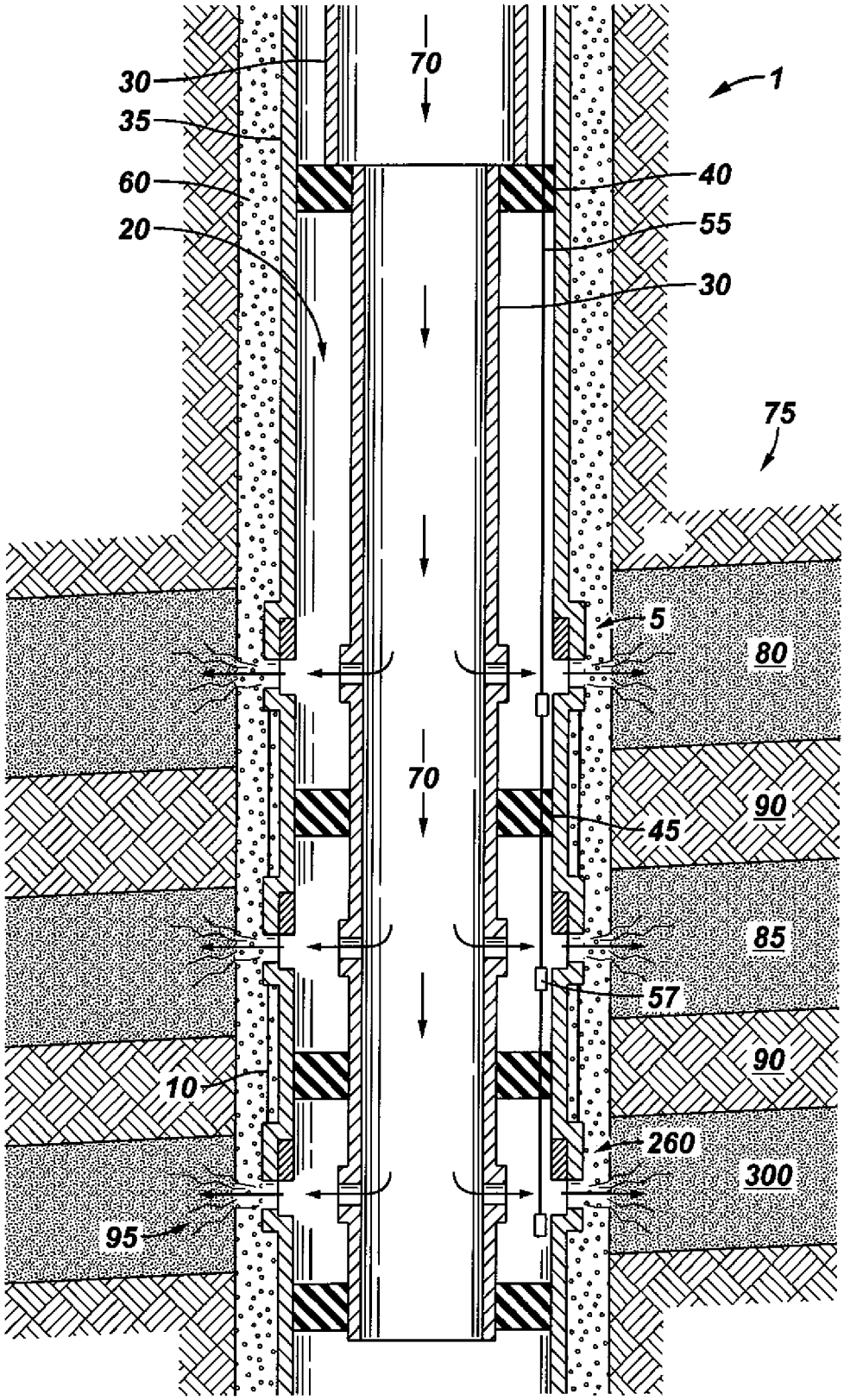
FIG. 14 illustrates a cross sectional side view of an injector well completion system having sliding sleeves with flow control valves for each sliding sleeve.

FIG. 14 illustrates a cross sectional side view of an embodiment of injector well completion system 1 having a plurality of flow control valves 260, with a flow control valve 260 for each zone 80, 85, and 300. In some embodiments, flow control valves 260 are actuated by pressure of liquid 70 in tubing bore 165. In other embodiments, flow control valves 260 are actuated by control lines 265 (not illustrated). FIG. 14 is shown with three zones 80, 85, and 300 for illustration purposes only but may also include more or less zones. In an embodiment, all flow control valves 260 are actuated to actuate sliding sleeves 5 and inject pressure into formation 75. In some embodiments, flow control valve 260 has only open and closed positions (i.e., an open/closed flow control valve). In other embodiments, flow control valve 260 has multiple or variable choke positions. Without being limited by theory, actuating individual flow control valves 260 may be accomplished for various reasons such as preventing water and/or gas breakthroughs in certain zones.

In alternative embodiments (not illustrated), sliding sleeve control line 10 is run to surface 255. In such alternative embodiments, sliding sleeves 5 may be actuated from surface 255. Without limitation, actuation from surface 255 allows multiple opening and closing of sliding sleeves 5. In other alternative embodiments (not illustrated), sliding sleeves 5 may be opened and closed multiple times by mechanically running a shifting tool into wellbore 20.

Without limitation, embodiments of injector well completion system 1 prevent cross flow between zones (i.e., zones 80, 85). For instance, as shown in FIG. 1, cement 100 between each sliding sleeve 5 provides zonal isolation. In embodiments with sliding sleeves 5 in closed positions, injector well completion system 1 provides fluid loss control and well control during deployment of the upper completion. Moreover, injector well completion system 1 provides confirmation of zonal isolation by providing cement 100 between each sliding sleeve 5 as well as providing large inner diameters.

Although the embodiments and advantages have been described in detail, it should be understood that various changes, substitutions and alterations may be made herein without departing from the spirit and scope of the invention as defined by the appended claims.

What is claimed is:

1. A completion system for fluid injection in a formation, the system comprising:

a casing cemented in a wellbore defined by the formation, said casing having at least one pressure actuated sliding sleeve incorporated thereinto;

a tubing bore disposed through said casing;

an actuator mandrel for disposal between a flow control device and an injection pressure communication port through said casing; and a pressure control valve and having an open position for actuating communication between the device and the port to inject the fluid into the formation, the actuating initiated by the sleeve allowing pressure from said bore to said pressure valve via a pressure communication passage of the sleeve.

2. The completion system of claim 1, wherein the actuator mandrel comprises a piston, and wherein the pressure actuates the piston providing longitudinal movement of the actuator mandrel.

3. The completion system of claim 1, wherein the at least one sliding sleeve further comprises a cover sleeve, and wherein the cover sleeve isolates the flow control device from the tubing bore when the pressure control valve is in a closed position.

4. The completion system of claim 1, wherein the flow control device comprises a screen.

5. The completion system of claim 1, wherein the flow control device comprises a back flow check valve.

6. The completion system of claim 5, wherein the back flow check valve comprises a sleeve back flow check valve.

7. The completion system of claim 5, wherein the back flow check valve comprises a ball back flow check valve.

8. The completion system of claim 5, wherein the back flow check valve comprises a concentric choke.

9. The completion system of claim 1, further comprising a sensor bridle and a sensor, wherein the sensor bridle is run inside the casing string.

10. The completion system of claim 1, further comprising a sensor bridle and a sensor, wherein the sensor bridle is run outside the casing string, and wherein the sensor bridle is cemented.

11. The completion system of claim 1, further comprising a fixed choke inflow control device.

12. The completion system of claim 1, further comprising a plurality of sliding sleeves, wherein sliding sleeve control lines connect the sliding sleeves for pressure communication between the sliding sleeves.

13. The completion system of claim 12, wherein opening of the pressure control valve allows pressure communication from one of the sliding sleeves to other sliding sleeves.

14. The completion system of claim 13, wherein the casing string comprises a tubing bore, and wherein the pressure communication to other sliding sleeves actuates actuator mandrels in the other sliding sleeves to inject liquid or gas from the tubing bore through the other sliding sleeves.

15. The completion system of claim 1, further comprising a plurality of sliding sleeves, wherein each of the sliding sleeves comprises a pressure control valve for actuation of an actuator mandrel.

16. The completion system of claim 1, further comprising a variable choke or an open/closed flow control valve and an isolated annulus zone portion, wherein the flow control valve controls liquid flow to the isolated annulus zone portion and a sliding sleeve disposed in the isolated annulus zone portion.

17. The completion system of claim 16, further comprising a lower flow control valve that controls liquid flow from a tubing bore of the casing string to the isolated annulus zone portion and the sliding sleeve disposed in the isolated annulus zone portion, and wherein the isolated annulus zone portion is downhole of the tubing bore.

18. The completion system of claim 17, further comprising sliding sleeve control lines for pressure communication between separate sliding sleeves.

19. The completion system of claim 1, further comprising an inflow control device, wherein the inflow control device is a fixed choke, an orifice, or a passageway inflow control device, and wherein the inflow control device controls liquid or gas flow to the at least one sliding sleeve.

20. The completion system of claim 19, further comprising a back flow check valve.

21. The completion system of claim 1, further comprising more than one flow control valve and more than one sliding sleeve, wherein the casing string comprises a tubing bore, and wherein each flow control valve controls liquid or gas flow from the tubing bore to more than one sliding sleeve.

* * * * *